United States Patent [19]

Rubinstein

[11] Patent Number: 4,560,108

[45] Date of Patent: Dec. 24, 1985

[54] SPRINKLER

[76] Inventor: Zvi Rubinstein, 14, Ilan St., Giv'at Shmuel, Israel

[21] Appl. No.: 602,390

[22] Filed: Apr. 20, 1984

[30] Foreign Application Priority Data

Apr. 20, 1983 [IL] Israel ..... 68440

[51] Int. Cl.[4] ..... B05B 3/04

[52] U.S. Cl. ..... 239/222.17

[58] Field of Search ..... 239/222.17, 231, 380, 239/381, 505, DIG. 16, 222.21

[56] References Cited

U.S. PATENT DOCUMENTS

| | | | |
|---|---|---|---|
| 477,164 | 6/1892 | Baker | 239/222.17 |
| 961,006 | 6/1910 | Perry | 239/222.17 |
| 4,261,515 | 4/1981 | Rosenberg et al. | 239/222.17 |

*Primary Examiner*—Jeffrey V. Nase
*Assistant Examiner*—Scott D. Malpede
*Attorney, Agent, or Firm*—Dennison, Meserole, Pollack & Scheiner

[57] ABSTRACT

A sprinkler comprising a spray nozzle adapted to be connected to a water supply pipe and having an axially extending jet outlet opposite which a flow distributor head is mounted coaxial with and rotatable relative to the nozzle, the distributor head having limited vertical movement and being provided with a flow divider in its central region facing the spray nozzle from which flow divider at least two outflow passages extend outwardly, a deflector wall at an angle to each outflow passage being provided at the exit of each of the outflow passages, the wall, when the flow impinges thereon, causing the rotation of the head, the flow divider includes a part on both sides of an imaginary plane which divides and is parallel to those parts of the outflow passages which lie in the region of the axis of the distributor head, the part of the divider on each side of the plane being more remote from the deflector wall of one outflow passage at the exit than the axis of the head and being oriented to force the flow toward the deflector wall.

3 Claims, 5 Drawing Figures

SPRINKLER

The present invention concerns sprinklers of the kind comprising a spray nozzle adapted to be connected to a water supply pipe and having an axially extending jet outlet opposite which a flow distributor head, i.e. a deflector head, is mounted on an axial shaft of the distributor head and is coaxial with and rotatable relative to said nozzle, said distributor head having limited vertical movement and being provided with a flow divider means or partition in its central region facing the spray nozzle from which flow divider at least two flow passages extend outwardly, a deflector wall at an angle to said passage being provided at the exit of each of said flow passages, said wall, when the flow impinges thereon, causing the rotation of the head.

The main disadvantage of these conventional sprinklers is the fact that when the pressure of the water is low the distribution is poor and the range of spraying is small. At high pressures it creates mist and is extremely sensitive to dirt particles in the water supply. Thus, if there are dirt particles present the head may stop its rotation altogether.

It is the object of the present invention to provide a sprinkler of the kind which will work substantially at any pressure and will overcome the abovementioned disadvantages.

The invention consists in a sprinkler of the kind comprising a spray nozzle adapted to be connected to a water supply pipe and having an axially extending jet outlet opposite which a flow distributor head, i.e. a deflector head, is mounted on an axial shaft of the distributor head and is coaxial with and rotatable relative to said nozzle, said distributor head having limited vertical movement and being provided with a flow divider means or partition in its central region facing the spray nozzle from which flow divider at least two flow passages extend outwardly, a deflector wall at an angle to said passage being provided at the exit of each of said flow passages, said wall, when the flow impinges thereon causing the rotation of the head, characterized in that in the flow passage of the distributor head a flow divider is provided on both sides of an imaginary plane which divides and is parallel to that part of the flow passage which lies in the region of the axis of the distributor head, part of the divider on each side of said plane being more remote from the deflector wall at the exit than the axis of the head and being oriented so that it forces the flow toward said deflector wall.

In one embodiment of the invention the said dividers merge into a plane including the axis of said shaft. In another embodiment of the invention the dividers extend at either side of said plane at right angles of the wall of said passage and equi-distant from the axis of said head.

The invention is illustrated by way of example only in the accompanying drawings in which.

Figure 1:
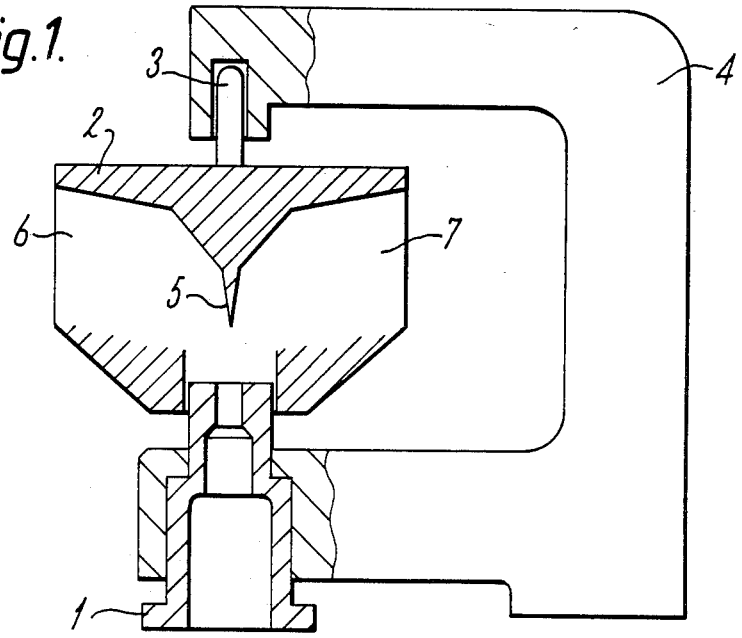
FIG. 1 is an elevation of the sprinkler according to the invention.

As shown in FIG. 1, the sprinkler comprises a nozzle 1, adapted to be connected to a water supply line (not shown), a flow distributor head 2 being mounted above the nozzle and co-axial therewith on an axially extending shaft 3 which is rotatably held in a bracket 4 in such a manner that a limited vertical movement of the distributor head relative the nozzle is possible, while the distributor head rotates.

In the central region of the distributor head 2, a flow divider 5 is provided and on either side thereof the outflow passages 6 and 7. These passages comprise a deflector wall 8 which may be straight as in FIGS. 2, 4 and 5, or curved as in FIG. 3.

Figure 2:
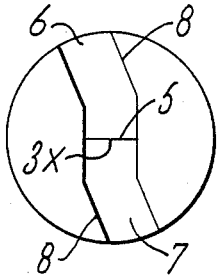
Fig.2. PRIOR ART
FIGS. 2 and 3 show schematic bottom views of the known distributor head.
Figure 3:
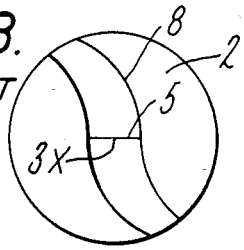
Fig.3. PRIOR ART

In the known flow distributor heads, as shown in FIGS. 2 and 3, the flow divider 5 extends transverse of the passage through the axis 3X of the distributor head. This construction has not proven to be satisfactory as above described.

Figure 4:
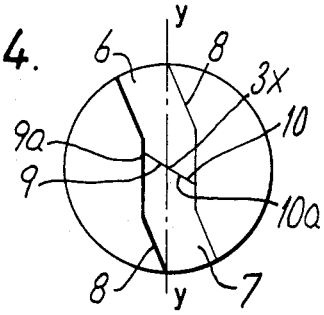
FIGS. 4 and 5 show schematic bottom views of the two embodiments of the distributor head according to the invention.

According to the invention and as shown in FIG. 4 the flow dividers 9, 10 extend on each side of an imaginary plane Y-Y which divides the flow passages 6 and 7 in the region of axis 3X, said plane being parallel to the walls of said passages. The flow dividers here merge into each other and include the axis 3X. Parts 9*a* and 10*a* of the dividers, respectively, are more remote from the deflector wall 8 and face said wall in such a manner that they force said flow against said wall.

Figure 5:
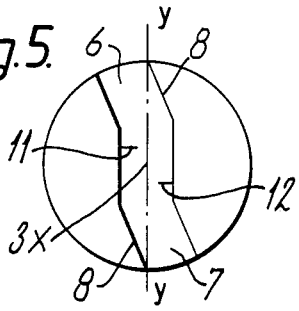

In the embodiment of the invention shown in FIG. 5, the flow dividers 11, 12 extend on either side of the imaginary plane Y-Y at right angles to the side walls of the flow passages 6 and 7 and at a space from axis 3X. Divider 11 will force the jet flow towards wall 8 of passage 7, while divider 12 will force the jet flow towards wall 8 of passage 6.

It has been shown that owing to this construcion of the flow dividers, the distributor head will rotate smoothly at any pressure in the line, causing good distribution of the flow and preventing the arrest of the head when dirt particles emerge from the nozzle.

I claim:

1. In a sprinkler of the kind comprising a spray nozzle adapted to be connected to a water supply pipe and having an axially extending jet outlet opposite which a flow distributor head, i.e., a deflector head, is mounted on an axial shaft of the distributor head and is coaxial with and rotatable relative to said nozzle, said distributor head having limited vertical movement and being provided with flow passage means thereacross, a flow divider in the central region of the flow passage means facing the spray nozzle from which flow divider at least two outflow passages extend, each outwardly to an exit, said divider having opposed flow directing sides faced by the outflow passages, a deflector wall at an angle to each said outflow passage being provided at the exit of each of said outflow passages, each said wall, when the flow impinges thereon, causing the rotation of the head; the improvement comprising the flow divider extending on both sides of an imaginary plane which divides and is parallel to that part of the flow passage means which lies in the region of the axis of the distributor head, said divider including a part thereof to each side of said plane with the part of the divider on each side of said plane being more remote from the deflector wall at the exit of a facing outflow passage than the axis of the head and being oriented so that it forces the flow toward said remote deflector wall.

2. A sprinkler as claimed in claim 1, wherein the said part of the divider on each side of said plane merges into a plane including the axis of said shaft.

3. A sprinkler as claimed in claim 1, wherein the part of the divider on each side of said plane extends at either side of said plane at right angles to the wall of said passage and equi-distant from the axis of said head.

* * * * *